US007963574B2

(12) United States Patent
Geringer et al.

(10) Patent No.: US 7,963,574 B2
(45) **Date of Patent: *Jun. 21, 2011**

(54) FAIL SAFE/FAIL SECURE LOCK WITH QUICK CHANGE ACCESS WINDOW

(75) Inventors: Arthur Geringer, Oak Park, CA (US); David Geringer, Camarillo, CA (US); Richard Geringer, Moorpark, CA (US)

(73) Assignee: Security Door Controls, Westlake Village, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/811,252

(22) Filed: Jun. 7, 2007

(65) Prior Publication Data

US 2007/0245784 A1 Oct. 25, 2007

Related U.S. Application Data

(63) Continuation of application No. 11/089,170, filed on Mar. 24, 2005, now Pat. No. 7,246,827.

(60) Provisional application No. 60/557,862, filed on Mar. 30, 2004.

(51) Int. Cl.
*E05C 1/06* (2006.01)

(52) U.S. Cl. ..... 292/144; 292/341.16

(58) Field of Classification Search ..... 292/144, 292/201, 341.16, 92; 70/92, 107
See application file for complete search history.

(56) References Cited

U.S. PATENT DOCUMENTS

| | | | | |
|---|---|---|---|---|
| 3,950,974 | A * | 4/1976 | Alexander | 70/450 |
| 4,017,107 | A | 4/1977 | Hanchett | 292/341.16 |
| 4,583,382 | A * | 4/1986 | Hull | 70/107 |
| 4,609,910 | A | 9/1986 | Geringer et al. | 340/545 |
| 4,626,010 | A | 12/1986 | Hanchett, Jr. et al. | 292/341.16 |
| 4,652,028 | A | 3/1987 | Logan et al. | 292/251.5 |
| 5,000,497 | A | 3/1991 | Geringer et al. | 292/251.5 |
| 5,484,180 | A | 1/1996 | Helmar | 292/341.16 |
| 5,876,073 | A * | 3/1999 | Geringer et al. | 292/144 |
| 6,299,225 | B1 * | 10/2001 | Chang | 292/341.16 |
| 6,354,121 | B1 * | 3/2002 | Frolov | 70/277 |
| 6,390,520 | B1 * | 5/2002 | Holzer | 292/341.17 |
| 6,619,705 | B2 | 9/2003 | Dalsing | 292/169.14 |
| 6,874,830 | B2 * | 4/2005 | Bashford | 292/341.16 |
| 7,052,054 | B2 | 5/2006 | Luker | 292/201 |

* cited by examiner

*Primary Examiner* — Gary Estremsky
(74) *Attorney, Agent, or Firm* — Koppel, Patrick, Heybl & Philpott

(57) ABSTRACT

An electric door lock interchangeable between fail safe and fail secure modes comprising a housing for receiving a plurality of internal components of the door lock. A window is included in the housing, the window allowing access to the internal components to change the operation of the lock between fail safe an fail secure modes.

16 Claims, 4 Drawing Sheets

FIG. 7
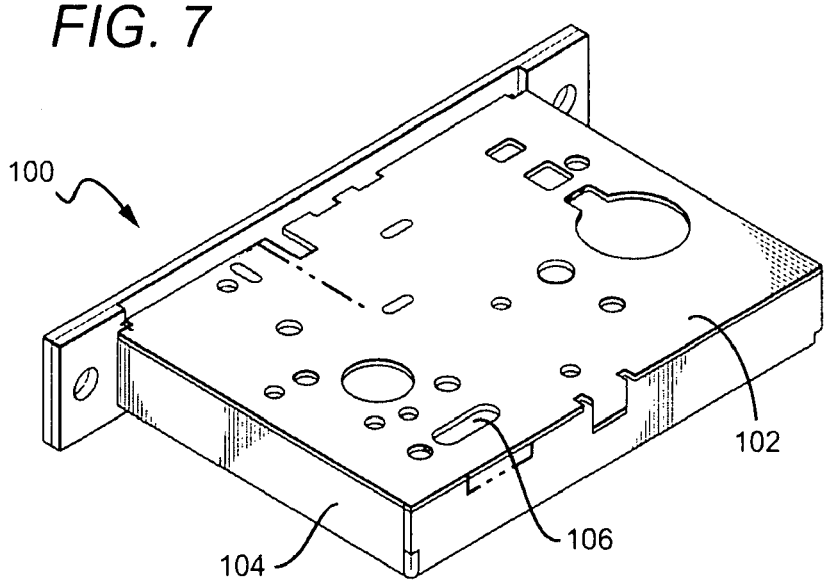
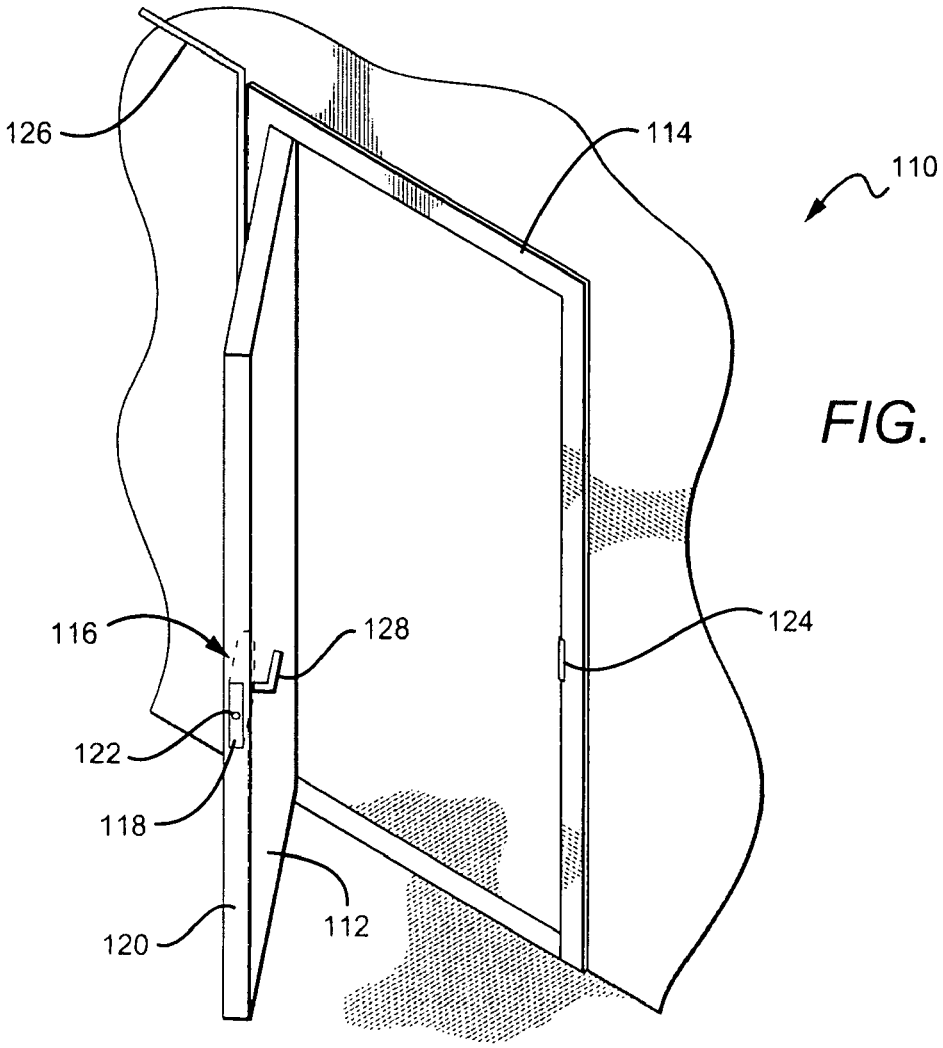
FIG. 8

FAIL SAFE/FAIL SECURE LOCK WITH QUICK CHANGE ACCESS WINDOW

RELATED APPLICATION

This application is a continuation of, and claims the benefit of, U.S. application Ser. No. 11/089,170 filed Mar. 24, 2005 U.S. Pat. No. 7,246,827 to Arthur Geringer, et al., issued Jul. 24, 2007, which claims the benefit of provisional application Ser. No. 60/557,862 to Geringer et al. filed on Mar. 30, 2004.

U.S. patent application Ser. No. 11/089,170 is hereby incorporated by reference.

BACKGROUND OF THE INVENTION

1. Field of the Invention

The present invention relates to door locks, and in particular to electric door locks that can be operated in both the fail-safe and fail-secure mode.

2. Description of the Related Art

Security doors to prevent theft or vandalism have evolved over the years from simple doors with heavy duty locks to more sophisticated egress and access control devices. Hardware and systems for limiting and controlling egress and access through doors are generally utilized for theft-prevention or to establish a secured area into which (or from which) entry is limited. For example, retail stores use such secured doors in certain departments (such as, for example, the automotive department) which may not always be manned to prevent thieves from escaping through the door with valuable merchandise. In addition, industrial companies also use such secured exit doors to prevent pilferage of valuable equipment and merchandise.

One type of door lock which has been used in the past to control egress and access through a door is an electromagnetic system which utilizes an electromagnet mounted on a door jamb, with an armature mounted on the door held by the electromagnet to retain the door in the closed position when the electromagnet is actuated. Such locking mechanisms are illustrated in U.S. Pat. No. 4,439,808, to Gillham, U.S. Pat. No. 4,609,910, to Geringer et al., U.S. Pat. No. 4,652,028, to Logan et al., U.S. Pat. No. 4,720,128 to Logan, Jr., et al., and U.S. Pat. No. 5,000,497, to Geringer et al. All of these references utilize an electromagnet mounted in or on a door jamb and an armature on the door held by the electromagnet to retain the door in the closed position. Such electromagnetic locking systems are quite effective at controlling egress and access through the door they are installed on. Unfortunately, however, such systems are quite expensive, and require a fairly complex installation, often with the electromagnet being mounted in the door jamb.

Another type of system which is known in the art is the electric door strike release mechanism, in which a latch bolt located in and extending from a locking mechanism located in a door is receivable in an electrically operable door strike mounted in the frame of the door. The door may be opened either by retracting the latch bolt into the locking mechanism to thereby disengage it from the door strike, or by electrically actuating the door strike mechanism to cause it to open and to thereby release the extended latch bolt from the door strike mechanism. Typically, such electrically operable door strikes pivot to allow the door to close without the door strike mechanism being electrically actuated. Such door strike mechanisms are illustrated in U.S. Pat. No. 4,017,107, to Hanchett, U.S. Pat. No. 4,626,010, to Hanchett et al., and in U.S. Pat. No. 5,484,180, to Helmar. Like the electromagnet/armature systems discussed above, electrically operated door strike systems are also expensive, and require a significant installation into the door jamb, which must usually be reinforced.

Electrically operable door locks have also been developed that can be installed on a door through which access is to be controlled by an electrically operable security system. Such a lock is disclosed in U.S. Pat. No. 5,876,073 to Geringer et al. The door opening mechanism of the door lock is selectively locked and unlocked by controlling the supply of electricity to the door lock to thereby control access or egress through the door. The electrically operable door lock uses an electromagnetic actuator to drive a locking member between a locked position in which it engages a latch actuating member to prevent it from being rotated to retract a latch bolt to open a door, and an unlocked position in which it is disengaged from the latch actuating member to allow it to be rotated to retract the latch bolt to open the door. By reversing the position of the electromagnetic actuator in the door lock apparatus, the system may operate in either a fail secure mode in which the electromagnetic actuator must be powered to unlock the door, or a fail safe mode in which the electromagnetic actuator must be powered to lock the door.

SUMMARY OF THE INVENTION

One embodiment of an electric door lock according to the present invention is interchangeable between fail safe and fail secure modes and comprises a housing for receiving a plurality of internal components of the door lock. A window is included in the housing, the window allowing access to the internal components to change the operation of the lock between fail safe and fail secure modes.

Another embodiment of an electric door lock according to the present invention that is interchangeable between fail safe and fail secure modes also comprises a housing for receiving a plurality of internal components of the door lock. The housing has a removable cover plate. A switching mechanism is included for altering the internal components to change the operation of the lock between fail safe and fail secure modes without removing the cover plate.

These and other features and advantages of the invention will be apparent to those skilled in the art from the following detailed description, taken together with the accompanying drawings.

BRIEF DESCRIPTION OF THE DRAWINGS

FIG. 7 is a perspective view of one embodiment of a lock according to the present invention with its cover in place; and FIG. 8 is a perspective view of a door utilizing a lock according to the present invention.

DETAILED DESCRIPTION OF THE INVENTION

The inventions herein are described with reference to a particular lock but it should be understood that the inventions can be similarly used in other types of locks and other devices unrelated to locks. The components described herein can have many different shapes and sizes beyond those shown and can be arranged in many different ways beyond those described herein.

One embodiment of a fail safe/fail secure lock according to the present invention comprises an electrically operable lock that can be changed to operate in either the fail safe mode or fail secure mode. It is generally understood in the industry that the fail safe mode of a lock describes a mode wherein the door can be opened by the lock doorknob when power to the lock is turned off or interrupted (i.e. power failure). Conversely, the fail secure mode describes a mode wherein the door cannot be opened by the doorknob when power to the lock is off or lost.

The lock generally comprises a lock housing holding the lock's internal components, which include a mechanism for allowing the lock to be changed between the fail safe and fail secure modes. In conventional locks, changing between the fail safe and fail secure modes requires opening the housing, such as by removing the cover, to access the internal components and manipulating the internal components. This can be an overly complex and inconvenient procedure and can result in damage to the internal components or lost internal components. Locks according to the present invention comprise a mechanism for allowing the lock to be changed without opening the lock housing. Different mechanisms can be used according to the present invention, with one mechanism being an access window that allows access to a limited section of the lock's internal components. The internal components can be accessed through the window to change the lock between fail safe and fail secure modes. The window and the lock's internal components are also arranged such that they remain secure and will not fall out of the lock housing through the access window. The lock also includes internal components that allow for improved reliability and extended life.

It will be understood that when an element is referred to as being "on", "connected to", "coupled to" or "in contact with" another element or layer, it can be directly on, connected or coupled to, or in contact with the other element or layer or intervening elements or layers may be present. In contrast, when an element is referred to as being "directly on", "directly connected to", "directly coupled to" or "directly in contact with" another element or layer, there are no intervening elements or layers present.

Figure 1:
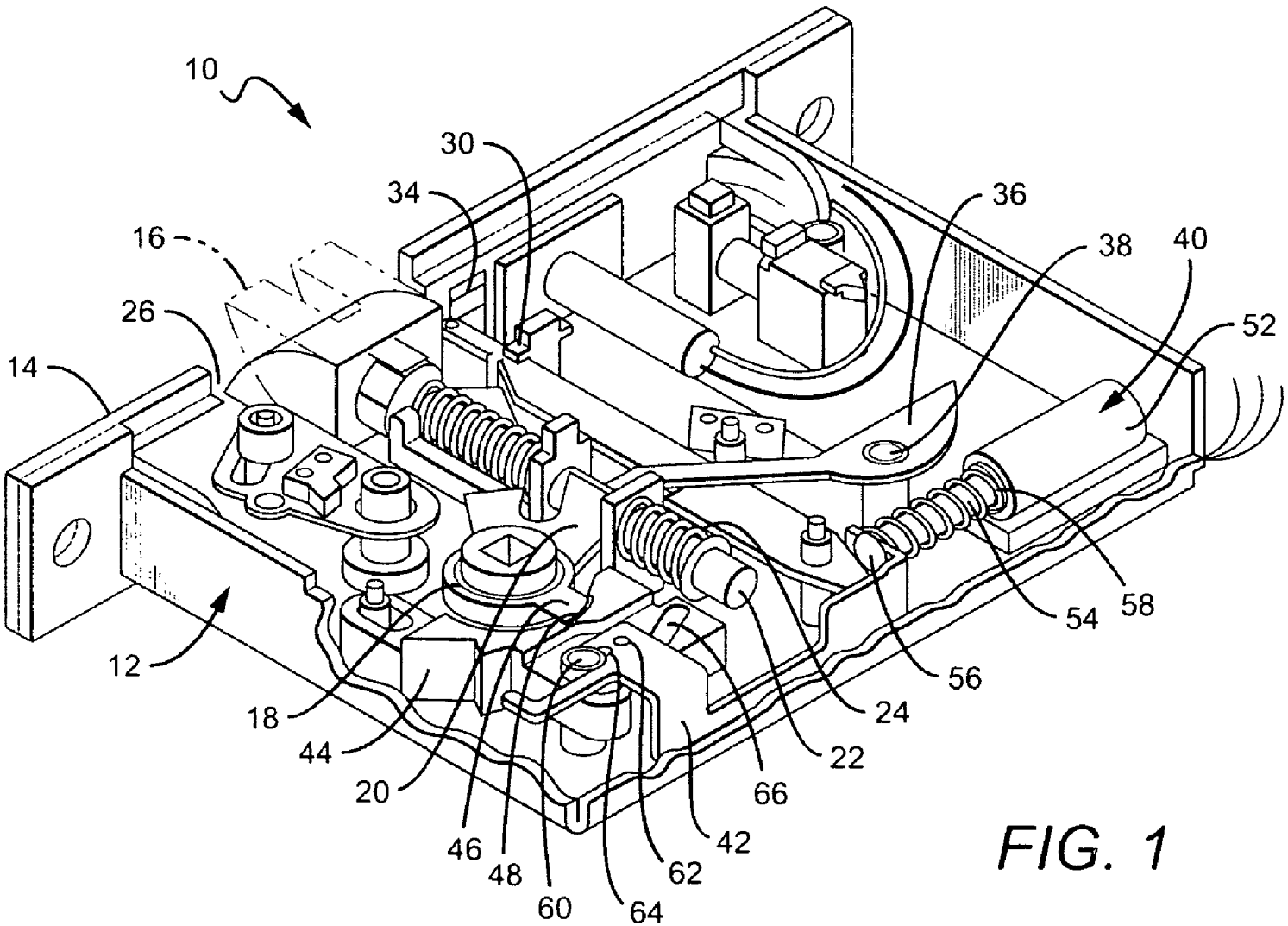
FIG. 1 is a perspective view of one embodiment of a lock according to the present invention with its cover removed so that its internal components are visible.
Figure 2:
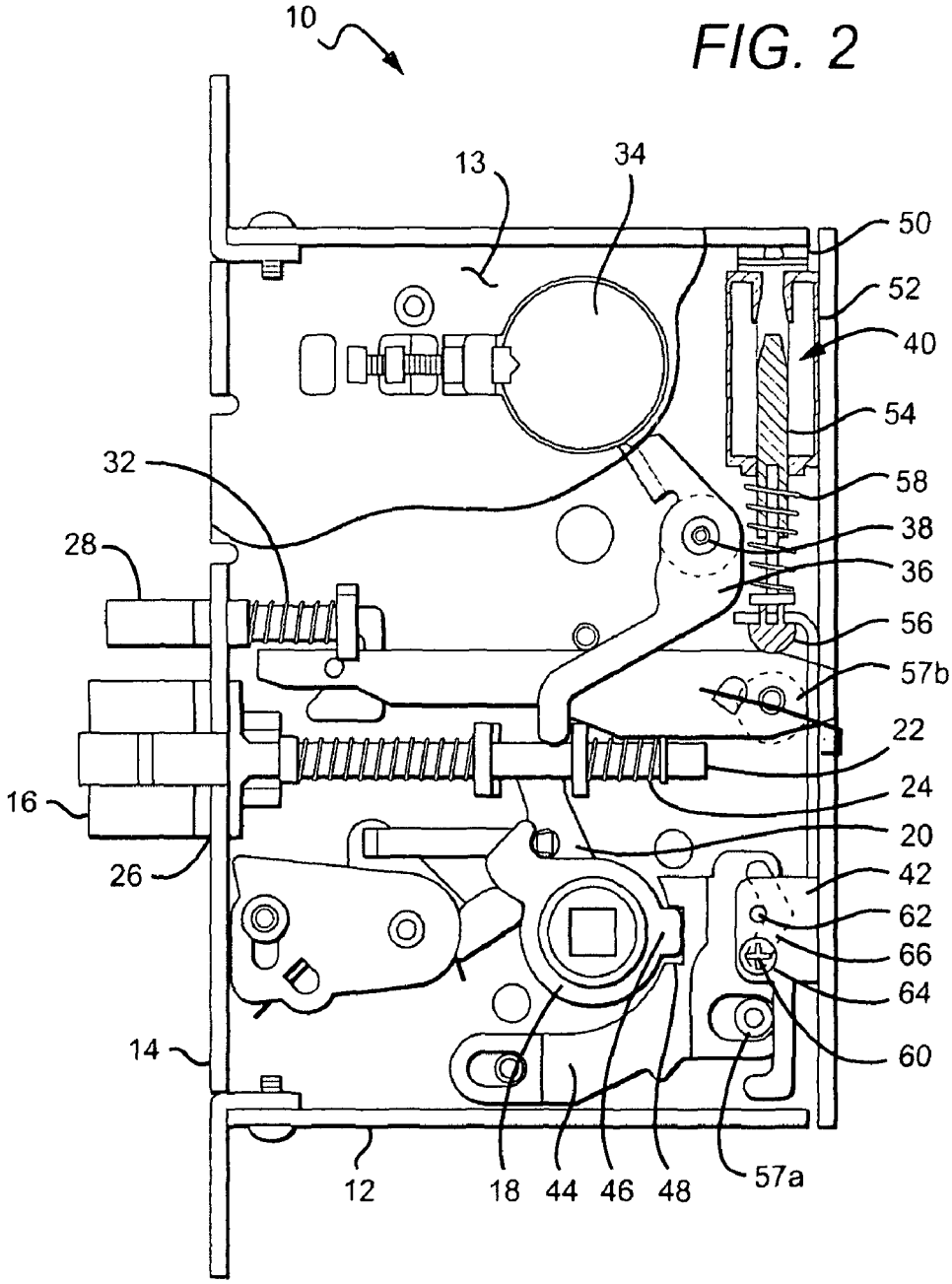
FIG. 2 is a plan view of one embodiment of a lock according to the present invention with its cover removed so that its internal components are visible.

FIGS. 1 and 2 show one embodiment of a lock 10 according to the present invention that can be quickly and easily changed to operate in either the fail safe or fail secure mode, without opening the housing. The lock 10 generally comprises a housing 12 that can be many different shapes and sizes, but has a height, width and depth so that it can be mounted within a door and is large enough to securely hold the lock's internal components described below. The housing can be made of many different rigid and durable materials, with a preferred material being a metal. The housing 12 is shown in FIGS. 1 and 2 with its cover plate removed so that the internal lock components are shown to facilitate explanation of the operation of the lock's internal components. The lock 10 in FIG. 1 is also shown with a portion of the back of housing cutaway so that the internal components can be viewed for ease of explanation. It is understood, however, that when the lock 10 is finally assembled (as shown in FIG. 7), the housing is complete with its cover plate installed such that the housing 12 and its cover plate surround and hold the internal lock components.

The housing 12 comprises a back plate 13 to which many of the lock's internal components are mounted. The lock further comprises a front plate 14 that is arranged so that when the lock 10 is installed in the door, the front plate 14 is flush with the leading edge of the door. A latch bolt 16 is mounted within the housing 12 and a pivotally mounted retraction lever 18 is also mounted within the housing 12 in proximity to the latch bolt 16. A doorknob or opening lever ("doorknob") can be mounted to the lock 10 at the retraction lever 18 such that rotation of the doorknob causes rotation of the retraction lever 18. In most embodiments an inside and outside doorknob can be mounted to the retraction lever 18 with the doorknobs being on opposite sides of the lock 10. The latch bolt 16 is urged to the extended position by the bias of latch bolt spring 24, and the retraction lever 18 has a retraction finger 20 that is mechanically coupled to the latch bolt rod 22 so that rotational movement of the retraction lever 18 overcome the bias of spring 24. This in turn causes the latch bolt 16 to retract into the housing 12.

As shown, the front portion of the latch bolt 16 extends through a bolt opening 26 in the front plate 14 in its extended position and is arranged to engage a strike plate (not shown) in a door frame. The latch bolt 16 can also be retracted as described above so that all or most of the latch bolt's front portion is retracted into the housing 12. In normal use, door lock 10 is mounted in a door to allow a user to operate a doorknob and the latch bolt 16 to release the door. When the door is locked by the door lock 10 the latch bolt 16 extends from front plate 14 to engage a strike plate (shown in FIG. 8). When the door can be opened, the latch bolt 16 is retracted and disengages from the strike plate.

An auxiliary latch 28 is mounted within the housing 12 parallel to the latch bolt 16, and comprises a front portion that extends from auxiliary latch opening 30 in the front plate 14. The auxiliary latch 28 is urged by the auxiliary latch spring 32 to the extended position, and the auxiliary latch 28 can be moved to a retracted position within the housing 10, against the force of spring 32, by a force applied to the end of auxiliary latch 28. In operation, the auxiliary latch 28 and spring 32 cooperate to hold the latch bolt 16 at a predetermined position. In one embodiment according to the present invention, the auxiliary latch 28 is arranged such that when in its retracted position, the latch bolt 16 can only be retracted by the inside doorknob and the key cylinder. When the auxiliary latch 28 is in its extended position the latch bolt 16 can be retracted. In operation, when the door is closed, the auxiliary latch 28 can be compressed by the frame of the door or the strike plate, and holds the latch bolt 16 at its extended position such that the latch bolt 16 is blocked against operation driven by the outside doorknob.

A key cylinder (not shown) can be mounted within cylinder opening 34 and a bolt lever 36 extends between the latch bolt rod 22 and the key cylinder. Operation of the key cylinder causes the bolt lever 36 to move about a bolt lever pin 38 such that when the proper key is inserted in the key cylinder and rotated, the bolt lever 36 is rotated about the bolt lever pin 38. When the end of the bolt lever 36 at the latch bolt 16 moves away from the front plate 14, the bolt lever 36 operates on the latch bolt 16 such that the latch bolt 16 retracts into the lock housing 12.

The lock 10 also comprises a solenoid 40, a locking arm 42, and a locking cam 44, all of which cooperate to allow or block the retraction lever 18 from operating under force of doorknob to retract the latch 16. This allows the lock 10 to operate in the fail safe and fail secure modes. The retraction lever 18 has a locking tab 46 that mates with a locking slot 48 in the locking cam 44. When the locking tab 46 is mated with the locking slot 48, the retraction lever 18 is blocked from retracting the latch bolt 16. Conversely, when the locking tab 46 is not mated with the locking slot 48 the retracting lever can retract the latch bolt 16.

The solenoid 40 is mounted near the top of the housing 10 at a solenoid holder 50. The solenoid 40 comprises a solenoid body 52 and a plunger 54, with the solenoid body 52 having an internal coil (not shown) that can be energized to create a magnetic field that operates to pull the plunger 54 within the solenoid body 52. The plunger 54 also comprises a plunger tip 56 with a plunger spring 58 arranged on the plunger 54, between the plunger tip 56 and solenoid body 52. When the solenoid 40 is energized, the plunger is drawn into the solenoid body 52 against the force of the spring 58, compressing the spring 58 between the solenoid body 52 and the plunger tip 56. When the solenoid 40 is not energized (such as in a power failure) the coil is not energized and the plunger 54 at least partially extends from the solenoid body 52 under force of the spring 58.

The plunger 54 is connected to one end of the locking arm 42 and as the plunger 54 goes though the movement of being drawn into and extending from the solenoid body 52, the locking arm 42 is pulled toward or pushed away from the solenoid body 52. First and second bushings 57*a* and 57*b* (shown in FIG. 2) are arranged within the housing 12 and adjacent to the locking arm 42 so that the locking arm 42 is substantially prevented from sliding toward the front plate 14. Instead, its primary motion is sliding back and forth under the force of, and in relation to, the solenoid 40.

The locking arm 42 is connected between the plunger 54 and the locking cam 44 and the locking arm 42 cooperates with the locking cam 44 to allow the lock 10 to operate in either the fail safe or fail secure mode. The locking arm 44 and locking cam 42 have cooperating switching mechanisms that can be manipulated to change the operation of the lock between fail safe and fail secure modes depending upon how the locking arm 42 is connected to the locking cam 44. Many different mechanisms can be utilized according to the present invention, and in one embodiment, the locking cam 44 has a slot that can be engaged by locking arm 42 using different engagement mechanisms, such as a screw, pin, rod, clamp, etc. The locking arm 42 has two engagement locations for mounting the engagement mechanism, with one of the two locations allowing engagement with the slot for operation of the lock in fail safe mode and the other for operation in the fail secure mode.

In one embodiment according to the present invention, and as shown in FIGS. 1 and 2, the two engagement locations on the locking arm 42 comprise a threaded fail safe hole 60 and a threaded fail secure hole 62. The engagement mechanism comprises a slot screw 64 that is also threaded to mate with the holes 60, 62. The holes 60, 62 are arranged over a V-shaped slot 66 in the locking cam 44 such that when the slot screw 64 is threaded into one of the holes 60, 62, the screw 64 passes into the slot 66.

Operation of the solenoid 50 causes the locking arm 42 to move forward and back with the action of the solenoid plunger 54, which in turn causes the screw 64 to slide within slot 66. As described above, the locking arm 42 does not substantially move toward the front plate 14 so that the sliding action of the screw 64 in the slot 66 causes the locking cam 44 to move forward and back in relation to the front plate 14. When the screw 64 is in the fail safe hole 60 as shown in FIG. 1, and power is off to the solenoid (or there is a power failure), the plunger 54 extends from the solenoid body 52 under the force of the spring 58 and the locking arm 42 is pushed toward the bottom plate of the housing 12. At the same time, the screw 64 slides within the slot 66, moving the locking cam 44 away from the front plate 14. This action moves the retraction lever's locking tab 46 out of the cam's locking slot 48, which in turn allows the retraction lever 18 to operate to retract the latch bolt 16. Accordingly, in this arrangement the lock 10 operates in fail safe mode by allowing the lock to operate when power is off or lost.

Figure 3:
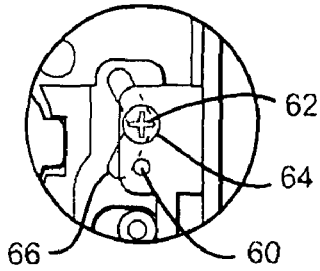
FIG. 3 is a plan view of a portion of the locking arm and cam mechanism shown in FIGS. 1 and 2.

Referring now to FIG. 3, the screw 64 is threaded into the fail secure hole 62. When power is off or there is a power failure, the locking arm is pushed down by the plunger 54. This causes the screw 64 to slide in the slot 66, but instead of moving the cam 44 away from the front plate 14, the cam is pushed toward the front plate. This causes the locking tab 46 to mate with the locking slot 48, which prevents the retraction lever 18 from retracting the latch bolt 16. In this arrangement the lock 10 operates in fail secure mode by not allowing the lock to operate when power is off or lost.

Figure 4:
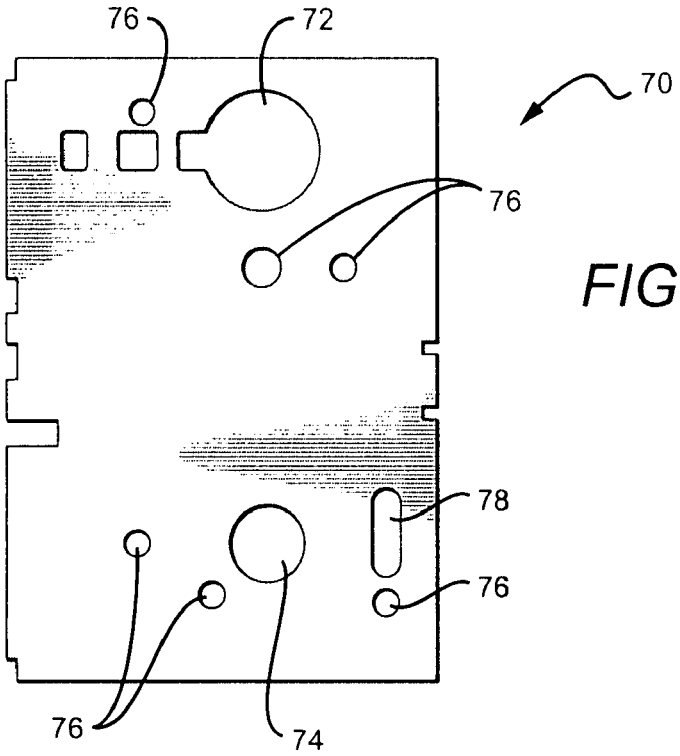
FIG. 4 is a plan view of one embodiment of a cover plate according to the present invention.

FIG. 4 shows one embodiment of a lock cover plate 70 according to the present invention that is arranged to fit over the lock 10 such that the housing 12 and cover plate 70 provide an enclosure for the lock's internal components. The plate comprises a key cylinder opening 72 so that a key can operate on the key cylinder, and a doorknob opening 74 so that a doorknob can be mounted to the retraction lever. The plate 70 also comprises several smaller holes 76 that can be used for mounting or to hold pins within the lock 10.

The plate 70 also comprises an access window 78 that is arranged over the screw 64, and the fail safe and fail secure holes 60, 62 (shown in FIGS. 1-3). The holes 60, 62 can be accessed through the window so that the screw 64 can be threaded into one of the holes without removing the plate 70. Similarly, the screw 62 can be removed from one of the holes 60, 62 through the window 78 and turned into the other of the holes 60, 62. This allows the lock 10 to be quickly and easily changed between the fail safe and fail secure modes without removing the front plate. This also allows the mode of the lock to be changed without the danger of damaging or misplacing the lock's internal components.

In one embodiment according to the present invention, the window is sized so that the screw 64 can be removed by a screwdriver or other similar tool. Other embodiments according to the present invention can have different sized windows, such as a window large enough to remove the screw using a larger tool, or by hand. In still other embodiments, the cover plate can have more than one window, such as two windows allowing the screw 64 to be removed from one of the holes through one window and inserted into the other hole through the second window.

Figure 5:
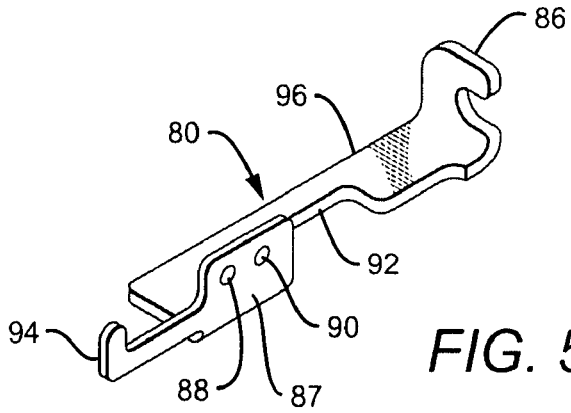
FIG. 5 is a perspective view of one embodiment of a locking arm according to the present invention.
Figure 6:
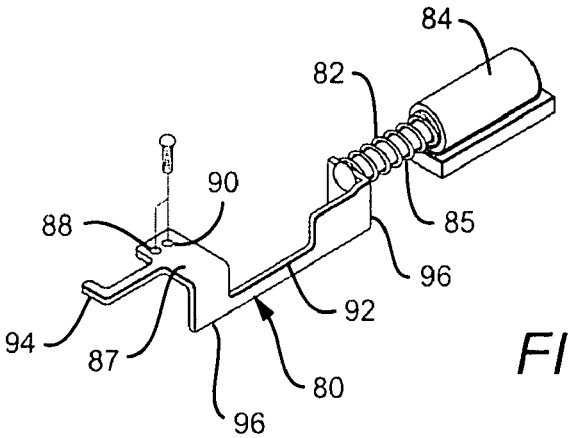
FIG. 6 is a perspective view of one embodiment of a locking arm and solenoid arrangement according to the present invention.

FIGS. 5 and 6 show one embodiment of a locking arm 80 according to the present invention, with the locking arm 80 coupled to the plunger 82 of a solenoid 84 as shown in FIG. 6. Like the solenoid described above, solenoid 84 has a spring to bias the plunger 82 in the extended position when the solenoid is not energized (power off or failure). The plunger end 86 of the locking arm 80 attaches to the solenoid plunger 82 (shown in FIG. 1). At the other end, the locking arm comprises a tab 87 having fail safe and fail secure holes 88, 90 as described in FIG. 1. A linking section 92 extends between the plunger end 86 and tab 87, and a stop 94 prevents the arm from extending too far down under action of the solenoid.

The locking arm 80 comprises an improvement over the prior art in that the prior locking arm comprises a surface that can be in contact with the lock's back (reference number 13 in FIGS. 1 and 2). This contact can cause a significant point of friction that can result in an added load to the operation of the solenoid. Any added load can reduce the life of a solenoid thereby reducing the overall life of the lock. The locking arm 80 contacts the back plate 13 along one edge 96 that results in much less friction between the arm 80 and back plate 13. The locking arm 80 also has less mass compared to prior mechanisms, such that the solenoid 84 can more easily move the locking arm 80 compared to prior mechanisms. This results in a reduced load on the solenoid 84, which further enhances reliability and lifespan of the solenoid 84.

FIG. 7 shows one embodiment of a lock 100 according to the present invention after the cover plate 102 has been mounted in place to the lock housing 104. The cover plate 102 has an access window 106 which allows for the lock 100 to be changed between the fail safe and fail secure modes as described above by changing the location of the slot screw between the fail safe and fail secure holes. In this embodiment, this is accomplished by accessing the slot screw with a screwdriver through the access window 106. This is typically done before the lock 100 is installed in a door. The lock is then installed in a door and connected to electrical conductors that carry a power and control signals to control whether the lock can be opened. When power from the conductors is off or lost, a fail condition exists and depending on the location of the slot screw, the lock will either be "safe" to be operated to open its door, or "secure" such that it cannot be operated to open its door.

FIG. 8 shows one embodiment of a door system 110 that can utilize a lock according to the present invention. The door system 110 comprises a door 112 mounted in a door frame, usually by hinges, such that the door 112 can swing open and closed on the hinges. A lock 116 according to the present invention, is mounted in the door 112 such that the lock's front plate 118 is flush with the door's leading edge 120. The latch bolt extends from the lock 116 and door 112 though the front plate 118 and is arranged to engage a strike plate 124 in the door frame 114 to hold the door closed. Electrical power and control signals are transmitted over conductors 126 that typically run from the door system controller (not shown), through the door frame 114 near the hinges, through the door 112 and into the lock 116. The lock 116 is configured to work in the fail safe or fail secure mode such that when power to the lock is interrupted, the lock will either be operable or not. If the lock is in the fail safe mode and door 112 is closed with the latch bolt 122 engaging the strike plate at the time power is interrupted, the lock will be operable at the handle 126 to open the door. If it is in the fail secure mode when power is interrupted, the handle 126 will not be operable to open the door 112.

Although the present invention has been described in considerable detail with references to certain preferred configurations thereof, other versions are possible. The invention can be used in different locks and different components can be used in the locks described above. Many different solenoids can be used in the lock including single or multiple stage coils that are operable with different voltages, such as 12 or 24 volts. The steps taken above to interchange the lock between fail safe and fail secure modes can be taken in different order and different steps can be used. Therefore the spirit and scope of the claims should not be limited to the preferred version contained herein.

We claim:

1. An electric door lock that is interchangeable between fail safe and fail secure modes, comprising:

a housing containing a plurality of internal components of the door lock including a locking cam, wherein said locking cam comprises a slot adapted to receive a screw; and a window in said housing, said slot accessible through said window wherein one of said modes is selected according to the position of said screw in said slot.

2. The lock of claim 1, wherein said internal components comprise said screw that is accessible through said window and cooperating with said locking cam, the position of said screw changeable to control whether said lock operates in the fail safe or fail secure mode.

3. The lock of claim 2, wherein said window is sized to allow access to said screw with a screwdriver to change the position of said screw.

4. The lock of claim 2, wherein said window is sized to allow access to said screw by hand to change the position of said screw.

5. The lock of claim 2, wherein said internal components comprise first and second screw holes, said screw positioned in one of said first and second locations to operate said lock in fail safe mode and positioned in the other to operate said lock in fail secure mode.

6. The lock of claim 2, wherein said internal components comprise a fail safe hole and a fail secure hole, each of which is arranged to accept said screw and said screw cooperating with said locking cam in each of said holes, said lock operating in fail safe mode when said screw is in said fail safe hole, and said lock operating in fail secure mode when said screw is in said fail secure hole.

7. The lock of claim 6, wherein said fail safe and fail secure holes are threaded and said screw is threaded to mate with said fail safe and fail secure holes.

8. An electric door lock that is interchangeable between fail safe and fail secure modes, comprising:

a housing containing a plurality of internal components of the door lock, said housing having a removable cover plate, at least one of said internal components comprising a slot; and a switching mechanism comprising a window to receive a screw, said slot adapted to receive said screw to select the operation of said lock between fail safe and fail secure modes without removing said cover plate.

9. The lock of claim 8, wherein the position of said screw is changeable to control whether said lock operates in the fail safe or fail secure mode.

10. The lock of claim 8, wherein said window is through said cover plate.

11. The lock of claim 8, wherein said window is sized to allow access to said screw with a screwdriver to change the position of said screw.

12. The lock of claim 8, wherein said window is sized to allow access to said screw by hand to change the position of said screw.

13. The lock of claim 8, wherein said internal components comprise first and second screw locations, said screw positioned in one of said first and second locations to operate said lock in fail safe mode and positioned in the other to operate said lock in fail secure mode.

14. The lock of claim 8, wherein said internal components comprise a fail safe hole and a fail secure hole, each of which is arranged to accept said screw, said lock operating in fail safe mode when said screw is in said fail safe hole, and said lock operating in fail secure mode when said screw is in said fail secure hole.

15. The lock of claim 14, wherein said fail safe and fail secure holes are threaded and said screw is threaded to mate with said fail safe and fail secure holes.

16. The lock of claim 8, wherein said internal components comprise a slot that cooperates with said screw.

* * * * *